US006349716B1

(12) United States Patent
Morton

(10) Patent No.: US 6,349,716 B1
(45) Date of Patent: Feb. 26, 2002

(54) KITCHEN VENTILATOR WITH INTERNAL DAMPER

(75) Inventor: Philip O'Farrell Morton, Washington County, OR (US)

(73) Assignee: Gaylord Industries, Inc., Tualatin, OR (US)

( * ) Notice: Subject to any disclaimer, the term of this patent is extended or adjusted under 35 U.S.C. 154(b) by 0 days.

(21) Appl. No.: 09/672,659

(22) Filed: Sep. 28, 2000

(51) Int. Cl.[7] ..... F24C 15/20
(52) U.S. Cl. ..... 126/299 R; 126/299 D
(58) Field of Search ..... 126/299 R, 299 D, 126/301, 21 R; 55/DIG. 36; 454/369, 347

(56) References Cited

U.S. PATENT DOCUMENTS

| | | | | |
|---|---|---|---|---|
| 1,994,365 A | | 3/1935 | Mathews | 196/116 |
| 2,961,941 A | * | 11/1960 | Graswich et al. | 126/299 R |
| 3,785,124 A | * | 1/1974 | Gaylord | 126/299 D |
| 4,029,002 A | | 6/1977 | Vandas | 98/115 K |
| 4,266,529 A | * | 5/1981 | Gaylord | 126/299 D |
| 4,281,635 A | | 8/1981 | Gaylord | 126/299 |
| 4,581,987 A | * | 4/1986 | Ulicny | 454/369 |
| 4,607,614 A | * | 8/1986 | Higashino et al. | 126/299 R |
| 4,784,144 A | | 11/1988 | Muckler et al. | 126/299 E |

FOREIGN PATENT DOCUMENTS

| | | | | |
|---|---|---|---|---|
| JP | 256739 | | 12/1985 | |
| JP | 22143 | | 1/1986 | |
| JP | 128049 | | 6/1986 | |
| JP | 5-106890 | * | 4/1993 | 126/299 D |

OTHER PUBLICATIONS

Gaylord GX–96 Ventilator Brochure, Gaylord Industries, Inc., 1979.
Gaylord Ventilator GX–AB Pamphlet, Gaylord Industries, Inc., Jul. 1983.
Gaylord Ventilator GX–BDL Pamphlet, Gaylord Industries, Inc., Jul. 1983.
K–Tech, "Finalist Wash Ventilator With Make–Up Section", Muckler Industries, Inc., 1/94.
Greenheck, "Installation, Operation, and Maintenance Manual, Automatic Fire Damper"6/99, pp. 1–12, 37–43.
Greenheck Kitchen Ventilation Systems, "Automatic Fire Damper for Greenheck Kitchen Hoods", 1/99.

* cited by examiner

*Primary Examiner*—James C. Yeung
(74) *Attorney, Agent, or Firm*—Thompson Hine LLP

(57) ABSTRACT

A ventilator includes a hood structure. A multi-position damper is located in an upper section of the hood structure.

23 Claims, 2 Drawing Sheets

KITCHEN VENTILATOR WITH INTERNAL DAMPER

FIELD OF THE INVENTION

The present invention relates generally to ventilators used in commercial kitchens, and more particularly, to a ventilator hood which includes an internal damper.

BACKGROUND OF THE INVENTION

Kitchen ventilator hoods have long been provided for the purpose of exhausting steam, smoke and particulates such as grease which are produced in the commercial kitchen environment. U.S. Pat. No. 4,281,635 describes a kitchen ventilator with a movable damper in a lower section of the ventilator near an air inlet slot, where the damper can be pivoted between open and closed positions. Other prior art ventilators have used a damper which is located in a duct collar located at the top of the ventilator such that the damper is normally located within the ceiling of a kitchen upon installation. However, in such arrangements access to the damper for purposes of repair or for monitoring its continued operation is difficult, particularly where the duct collar is positioned within a duct shaft when installed. Further, placement of the damper in the duct collar can make installations difficult, particularly when dealing with ceilings or duct shafts.

SUMMARY OF THE INVENTION

In one aspect of the present invention, a kitchen ventilator includes a hood structure for positioning over a cooking area. The hood structure includes a front side having a module slot which receives at least one removable extractor module. An air inlet slot is positioned below the extractor module when the extractor module is mounted in the module slot. A duct collar is located along a top of the hood structure. The extractor module defines at least one grease extraction baffle along a flow path from the air inlet slot to the duct collar when the extractor module is mounted in the module slot. A multi-position damper is located within the hood structure and is positionable in both an exhaust position and a non-exhaust position. The damper is positioned across the flow path when in the non-exhaust position for preventing flow of gases through the hood structure to the duct collar, and the damper is positioned above the module slot when in the non-exhaust position so as to prevent flow of gases through the hood structure to the duct collar even when the extractor module is removed from the module slot.

A further aspect of the present invention provides a kitchen ventilator including a hood structure for positioning over a cooking area. The hood structure includes an air inlet slot positioned toward a lower portion of the hood structure. An exhaust duct collar is positioned at a top side of the hood structure. At least one grease extraction baffle is located along a flow path from the air inlet slot to the duct collar. A multi-position damper is located within the hood structure, and is positionable in both an exhaust position and a non-exhaust position. The damper is positioned across the flow path when in the non-exhaust position for preventing flow of gases through the hood structure to the duct collar, and the damper is positioned in an upper section of the hood structure spaced away from the air inlet slot and spaced from the duct collar.

DETAILED DESCRIPTION OF THE EMBODIMENTS

Figure 1:
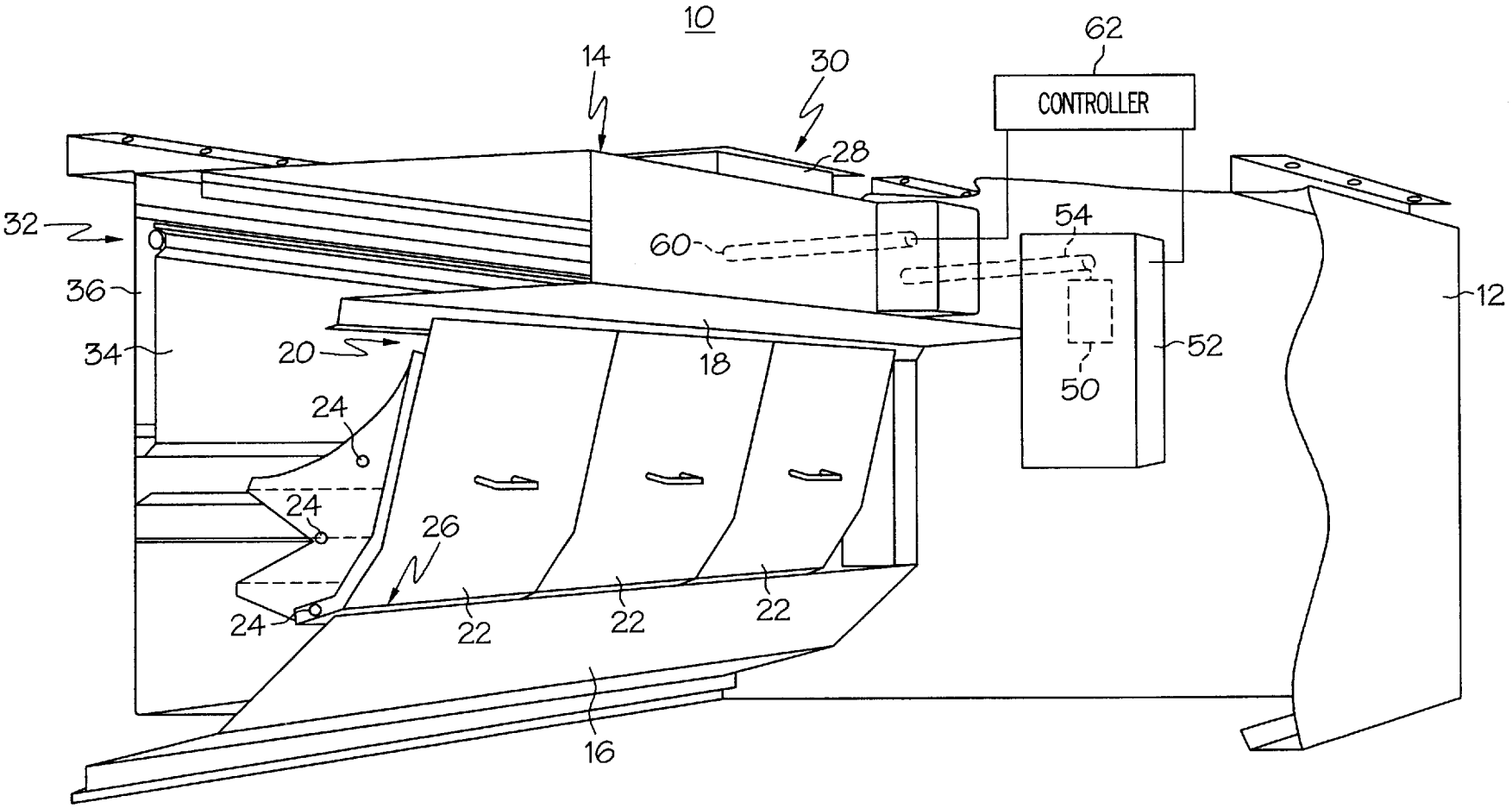
FIG. 1 is a perspective view of a ventilator.

Referring to drawing FIG. 1, a ventilator 10 is shown in perspective view with part of the front and left sides cut away. The ventilator 10 is typically positioned above a large commercial cooking area (not shown) which may include one or more cooking stations such as a griddle, range, fryer, and/or broiler, and is typically mounted to a wall or hung from the ceiling over the cooking area.

The ventilator 10 includes an outer housing 12 with an open bottom, the housing 12 encompassing an interior hood structure 14. The hood structure 14 includes a lower panel 16 and an upper panel 18 at its front side which define a module slot 20 for receiving one or more extractor modules 22. The interior side of each extractor module 22 forms one or more grease extraction baffles 24. An air inlet slot 26 is provided at a lower portion of the hood structure, below the modules 22. In the illustrated embodiment the air inlet slot 26 is defined by the lower panel 16 and a lower portion of the modules 22.

An exhaust outlet 30 of the hood structure 14 is located along a top portion of the hood structure 14 and leads to a duct collar 28 atop the hood structure 14. The duct collar 28 may be mounted to duct work at the time of ventilator installation.

In this configuration the flow path through the ventilator 10 extends from the air inlet slot 26, up through the interior of the hood structure past the grease extraction baffles 24 to an upper section 32 of the hood structure 14 and to the exhaust outlet 30 which leads to the duct collar 28.

A multi-position damper 34 is located within the upper section 32 of the hood structure 14 and is positionable in both an exhaust position for allowing gases to flow freely along the flow path and a non-exhaust position for preventing free flow of gases through the ventilator. As shown in FIG. 1 the damper 34 may be located adjacent a rear panel 36 of the hood structure 14 when in the exhaust position. The damper may be pivoted so as to be positioned across the flow path (as shown in the side elevation of FIG. 2) when in the non-exhaust position for preventing flow of gases through the hood structure 14 to the duct collar 28. The term "multi-position damper" as used herein refers to a damper which may be moved between two or more positions.

Figure 2:
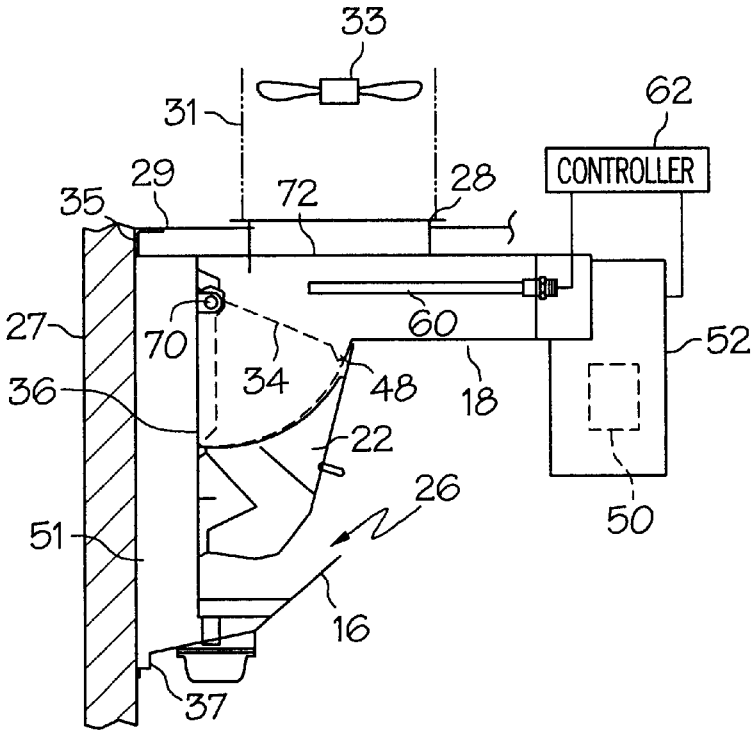
FIG. 2 is a side elevation of the ventilator of FIG. 1.
Figure 3:
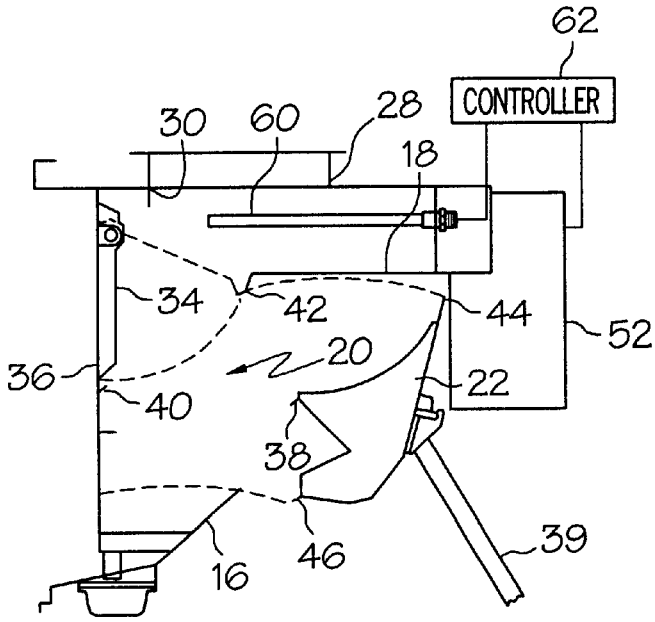
FIG. 3 is a side elevation of the ventilator of FIG. 1 showing removal of an extractor module.

FIGS. 2 and 3 show the hood structure 14 (front housing absent) in side views. As shown the extractor modules 22 may be removed from the module slot 20 by lifting them slightly and pulling them out of the slot 20 using an elongated removal tool 39. An interior side of each module 22 includes a flange 38 for positioning over an upwardly angled mounting flange 40 positioned along the rear side of the hood in order to support the module 22 when mounted in the slot 20. The upper panel 18 extends inward of the ventilator 10 into the upper section 32 and includes a downward turned flange 42 against which an upper flange 44 of each module 22 rests when mounted in the module slot 20. A lower flange 46 is also provided for resting against the rear panel 36 of the hood structure 14 when the extractor module 22 is mounted in the module slot 20.

FIG. 2 shows a mounting arrangement adjacent a wall 27, with ceiling 29 extending over the hood structure 29. The duct collar 28 extends into the ceiling 29 for connection to appropriate exhaust duct work 31, which may or may not include a duct shaft into which the duct collar extends. The duct work 31 typically has a fan 33 included somewhere therealong for pulling gases through the ventilator. In the illustrated installation, the rear panel 36 extends slightly outward from mounting flanges 35 and 37 to provide a built in air space 51 between the wall 27 and the rear panel 36 as needed in some mounting applications.

The damper 34 is positioned above the module slot 20 when in the non exhaust position so as to prevent flow of gases through the hood structure 14 to the duct collar 28 even when one or more of the extractor modules 22 is removed from the module slot 20. Such positioning aids in preventing spread of fire to the exhaust duct even when one or more of the extractor modules 22 is removed. In this regard, an inner portion 48 of the upper panel 18 forms a contact surface against which the movable end of the damper 34 is positioned when in the non-exhaust position to prevent the flow of gases. It is recognized that a perfect seal is not necessary between the movable end of the damper 34 and the contact surface and therefore preventing the "flow" of gases to the duct collar 28 does not require that the passage of any and all gases be prevented. The movable end of the damper 34 moves in the direction of gases moving along the flow path from the air inlet slot 26 to the duct collar 28 when the damper 34 is moved from the exhaust position to the non-exhaust position. Operation of the damper 34 may be easily observed when one or more modules 22 is removed. The damper 34 is pivoted at point 70 located in the upper rear corner of the hood structure 14, near the intersection of rear panel 36 and a top panel 72 of the hood structure.

Referring again to FIG. 1, a damper motor 50 may be provided in a motor enclosure 52 with a linkage 54 extending from the damper motor 50 to the damper 34 to cause pivoting movement of the damper 34. The damper motor 50 may be a spring-return type damper motor which is configured to position the linkage 54 at a default position when the motor is not energized. The connection between the damper motor 50, linkage 54 and damper 34 may be set so that the damper 34 is placed in the non-exhaust position when the motor 50 is not energized. In this manner power failures will cause the damper 34 to move to the non-exhaust position.

A temperature sensor 60, such as a thermostat for example, is positioned in the upper section 32 of the hood structure 14 for monitoring temperature. In the illustrated position below the duct collar 28 the temperature sensor monitors the temperature within the hood structure at the opening 30 which leads to the duct collar 28. The sensor 60 provides an output to a controller 62 which is also connected to control the energization of the damper motor 50. The controller 62 may be operable to de-energize the damper motor 50 when a temperature in the ventilator exceeds a threshold temperature (which may be indicative of a fire) for positioning the damper 34 in the non-exhaust position.

In the illustrated embodiment the damper 34 is positioned above the baffles 24, but below the temperature sensor 60.

The controller 62 may be of any suitable configuration desired, including, but not limited to, an electric controller formed by relays and contacts, as well as an electronic controller or programmable logic controller, or any combination of the same.

Although the invention has been described and illustrated in detail it is to be clearly understood that the same is intended by way of illustration and example only and is not intended to be taken by way of limitation.

For example, although the illustrated embodiment has been described as an embodiment in which removable extractor modules 22 are provided, it is recognized that positioning of the damper 34 in the upper section of the hood structure 14 may also be useful in ventilators which do not include removable extractor modules. In such cases a kitchen ventilator may be provided which includes a hood structure for positioning over a cooking area. The hood structure may include an air inlet slot positioned toward a lower portion of the hood structure. An exhaust duct collar may be positioned at a top side of the hood structure. At least one grease extraction baffle located along a flow path from the air inlet slot to the duct collar. A multi-position damper may be located within the hood structure, and may be positionable in both an exhaust position and a non-exhaust position. The damper may be positioned across the flow path when in the non-exhaust position for preventing flow of gases through the hood structure to the duct collar, and the damper may be positioned in an upper section of the hood structure spaced away from the air inlet slot and spaced from the duct collar.

In one embodiment positioning the damper in the upper section of hood structure provides the advantage of not requiring additional structure, such as a motor and linkage housing, on the top of the hood structure near the duct collar where such additional structure can interfere with installation of the ventilator.

Accordingly, the spirit and scope of the invention are to be limited only by the terms of the appended claims.

What is claimed is:

1. A kitchen ventilator, comprising:

a hood structure for positioning over a cooking area, the hood structure including a front side having a module slot which receives at least one removable extractor module, an air inlet slot positioned below the extractor module when the extractor module is mounted in the module slot;

a duct collar located along a top of the hood structure;

wherein the extractor module defines at least one grease extraction baffle along a flow path from the air inlet slot to the duct collar when the extractor module is mounted in the module slot; and a multi-position damper located within the hood structure, the damper positionable in both an exhaust position and a non-exhaust position, the damper positioned across the flow path when in the non-exhaust position for preventing flow of gases through the hood structure to the duct collar, the damper positioned above the module slot when in the non-exhaust position so as to prevent flow of gases through the hood structure to the duct collar even when the extractor module is removed from the module slot.

2. The ventilator of claim 1, wherein a lower portion of the extractor module cooperates with a lower panel of the hood structure to define the air inlet slot.

3. The ventilator of claim 1, wherein the module slot is defined in part by an upper panel which extends inward of the ventilator to define a contact surface against which a movable end of the damper is positioned when the damper is in the non-exhaust position.

4. The ventilator of claim 1, wherein a movable end of the damper moves with a flow direction of exhaust gases along the flow path when the damper is moved from the exhaust position to the non-exhaust position.

5. The ventilator of claim 1, further comprising:

a spring-return damper motor operatively connected for movement of the damper, with a non-energized default position of the spring-return damper motor set to place the damper in the non-exhaust position.

6. The ventilator of claim 5, further comprising:

a temperature sensor positioned within the hood structure; and a controller receiving an output of the temperature sensor and controlling the spring-return damper motor, the controller operable to de-energize the damper motor when a temperature in the ventilator exceeds a threshold temperature for positioning the damper in the non-exhaust position.

7. The ventilator of claim 1, wherein the damper is positioned adjacent a rear panel of the hood structure when in the exhaust position.

8. A kitchen ventilator, comprising:

a hood structure for positioning over a cooking area, the hood structure including an air inlet slot positioned toward a lower portion thereof;

an exhaust duct collar positioned at a top side of the hood structure;

at least one grease extraction baffle located in the hood structure along a flow path from the air inlet slot to the duct collar; and a multi-position damper located within the hood structure, the damper positionable in both an exhaust position and a non-exhaust position, the damper positioned across the flow path when in the non-exhaust position for preventing flow of gases through the hood structure to the duct collar, the damper positioned in an upper section of the hood structure spaced away from the air inlet slot and spaced from the duct collar.

9. The ventilator of claim 8 wherein the damper is positioned above the grease extraction baffle.

10. The ventilator of claim 9, wherein the hood structure includes at least one removable extractor module which defines the grease extraction baffle, wherein when in the non-exhaust position the damper is positioned above an opening created by removal the extractor module so as to prevent flow of gases through the hood structure to the duct collar even when the extractor module is removed.

11. The ventilator of claim 10, wherein a lower portion of the extractor module cooperates with a lower panel of the hood structure to define the air inlet slot.

12. The ventilator of claim 8, wherein the hood structure includes an upper panel which extends inward of the ventilator into the upper section to define a contact surface against which a movable end of the damper is positioned when the damper is in the non-exhaust position.

13. The ventilator of claim 8, wherein a movable end of the damper moves with a flow direction of exhaust gases along the flow path when the damper is moved from the exhaust position to the non-exhaust position.

14. The ventilator of claim 8, further comprising a spring-return damper motor operatively connected for movement of the damper, with a non-energized default position of the spring-return damper motor set to place the damper in the non-exhaust position.

15. The ventilator of claim 14, further comprising a temperature sensor positioned within the hood structure, a controller receiving an output of the temperature sensor and controlling the spring-return damper motor, the controller operable to de-energize the damper motor when a temperature in the ventilator exceeds a threshold temperature for positioning the damper in the non-exhaust position.

16. The ventilator of claim 8 wherein the multi-position damper includes an end which is pivotally connected adjacent an intersection of a rear panel and a top panel of the hood structure.

17. The ventilator of claim 8, wherein the multi-position damper is formed by a single panel damper having one end pivotally connected adjacent a rear panel of the hood structure.

18. A kitchen ventilator, comprising:

a hood structure for positioning over a cooking area, the hood structure including a front side having a module slot which receives at least one removable extractor module, an air inlet slot positioned below the extractor module when the extractor module is mounted in the module slot;

a duct collar located along a top of the hood structure;

wherein the extractor module defines at least one grease extraction baffle along a flow path from the air inlet slot to the duct collar when the extractor module is mounted in the module slot;

a multi-position damper located within the hood structure, the damper positionable in both an exhaust position and a non-exhaust position, the damper positioned across the flow path when in the non-exhaust position for preventing flow of gases through the hood structure to the duct collar, the damper positioned above the module slot when in the non-exhaust position so as to prevent flow of gases through the hood structure to the duct collar even when the extractor module is removed from the module slot; and a motor operatively connected for movement of the damper between the exhaust position and the non-exhaust position;

wherein the module slot is defined in part by an upper panel which extends inward of the ventilator to define a contact surface against which a movable end of the damper is positioned when the damper is in the non-exhaust position.

19. A kitchen ventilator, comprising:

a hood structure for positioning over a cooking area, the hood structure including an air inlet slot positioned toward a lower portion thereof;

an exhaust duct collar positioned at a top side of the hood structure;

at least one grease extraction baffle located in the hood structure along a flow path from the air inlet slot to the duct collar;

a multi-position damper located within the hood structure, the damper positionable in both an exhaust position and a non-exhaust position, the damper positioned across the flow path when in the non-exhaust position for preventing flow of gases through the hood structure to the duct collar, the damper positioned in an upper section of the hood structure spaced away from the air inlet slot and spaced from the duct collar; and a motor operatively connected for moving the damper between the exhaust position and the non-exhaust position;

wherein the hood structure includes an upper panel which extends inward of the ventilator into the upper section to define a contact surface against which a movable end of the damper is positioned when the damper is in the non-exhaust position.

20. A kitchen ventilator, comprising:

a hood structure for positioning over a cooking area, the hood structure including a front side having a module slot which receives at least one removable extractor module, an air inlet slot positioned below the extractor module when the extractor module is mounted in the module slot;

a duct collar located along a top of the hood structure;

wherein the extractor module defines at least one grease extraction baffle along a flow path from the air inlet slot to the duct collar when the extractor module is mounted in the module slot;

a multi-position damper located within the hood structure, the damper positionable in both an exhaust position and a non-exhaust position, the damper positioned across the flow path when in the non-exhaust position for preventing flow of gases through the hood structure to the duct collar, the damper positioned above the module slot when in the non-exhaust position so as to prevent flow of gases through the hood structure to the duct collar even when the extractor module is removed from the module slot; and a motor operatively connected for moving the multi-position damper.

21. A kitchen ventilator, comprising:

a hood structure for positioning over a cooking area, the hood structure including an air inlet slot positioned toward a lower portion thereof;

at least one grease extraction baffle located in the hood structure along a flow path from the air inlet slot;

a temperature sensor positioned within the hood structure;

a multi-position damper located within an upper section of the hood structure above the grease extraction baffle, the multi-position damper movable between an exhaust position and a non-exhaust position, the damper positioned across the flow path when in the non-exhaust position for preventing flow of gases through the hood structure, wherein the multi-position damper is located below the temperature sensor;

a motor operatively connected for moving the multi-position damper between the exhaust position and the non-exhaust position; and a controller receiving an output of the temperature sensor and controlling the motor.

22. A kitchen ventilator, comprising:

a hood structure for positioning over a cooking area, the hood structure including a front side having a module slot which receives at least one removable extractor module, an air inlet slot positioned below the extractor module when the extractor module is mounted in the module slot;

wherein the extractor module defines at least one grease extraction baffle along a flow path from the air inlet slot when the extractor module is mounted in the module slot;

a multi-position damper located within an upper section of the hood structure, the damper positionable in both an exhaust position and a non-exhaust position, the damper positioned across the flow path when in the non-exhaust position for preventing flow of gases through the hood structure, the damper visible through the module slot when the extractor module is removed from the module slot; and a motor operatively connected for movement of the multi-position damper.

23. A kitchen ventilator, comprising:

a hood structure for positioning over a cooking area, the hood structure including a front side having a module slot which receives at least one removable extractor module, an air inlet slot positioned below the extractor module when the extractor module is mounted in the module slot, wherein the extractor module defines at least one grease extraction baffle along a flow path of the hood structure;

a multi-position damper located within the hood structure, the damper positionable in both an exhaust position and a non-exhaust position, the damper positioned across the flow path when in the non-exhaust position for preventing flow of gases through the hood structure to the duct collar, the damper positioned above the module slot when in the non-exhaust position so as to prevent flow of gases through the hood structure to the duct collar even when the extractor module is removed from the module slot; and a motor operatively connected for movement of the damper between the exhaust position and the non-exhaust position;

wherein the module slot is defined in part by an upper panel which extends inward of the ventilator to define a contact surface against which a movable end of the damper is positioned when the damper is in the non-exhaust position.

* * * * *